US005153375A

United States Patent [19]

Eguizabal

[11] Patent Number: 5,153,375

[45] Date of Patent: Oct. 6, 1992

[54] AMMUNITION CARTRIDGE FOR SIMULATED FIRING USING A LASER BEAM

[76] Inventor: Julian Eguizabal, Churruca, 2-10 Izda., 20004 San Sebastian, Guipuzcoa, Spain

[21] Appl. No.: 837,556

[22] Filed: Feb. 14, 1992

Related U.S. Application Data

[63] Continuation of Ser. No. 683,531, Apr. 10, 1991, abandoned.

[51] Int. Cl.[5] ..... C06D 5/00; F42B 8/04

[52] U.S. Cl. ..... 102/530; 102/447

[58] Field of Search ..... 102/444-447, 102/530, 531; 42/77; 89/14.5; 434/11, 16-21

[56] References Cited

U.S. PATENT DOCUMENTS

| | | | |
|---|---|---|---|
| 1,804,986 | 5/1931 | Holden et al. | 102/530 |
| 3,583,087 | 6/1971 | Huebner | 102/444 |
| 3,938,262 | 2/1976 | Dye et al. | 434/21 |
| 4,719,859 | 1/1988 | Ballreich et al. | 102/444 |
| 4,983,123 | 1/1991 | Scott et al. | 434/21 |

FOREIGN PATENT DOCUMENTS

| | | | |
|---|---|---|---|
| 49125 | 4/1982 | European Pat. Off. | 102/444 |
| 1229417 | 11/1966 | Fed. Rep. of Germany | 102/447 |
| 1448834 | 7/1966 | France | 102/444 |
| 11725 | 6/1888 | United Kingdom | 102/530 |
| 726141 | 3/1955 | United Kingdom | 89/14.5 |

*Primary Examiner*—Harold J. Tudor
*Attorney, Agent, or Firm*—Lucas & Just

[57] ABSTRACT

Ammunition cartridge for simulated firing using a laser beam, this comprising a casing which is bored longitudinally and provided with, at the inlet of the bore, a percussion cap, the outlet of the bore fitting the orifice of the firearm barrel, its external form including additional forms of a casing and a conventional bullet.

2 Claims, 1 Drawing Sheet

AMMUNITION CARTRIDGE FOR SIMULATED FIRING USING A LASER BEAM

Figure 1:
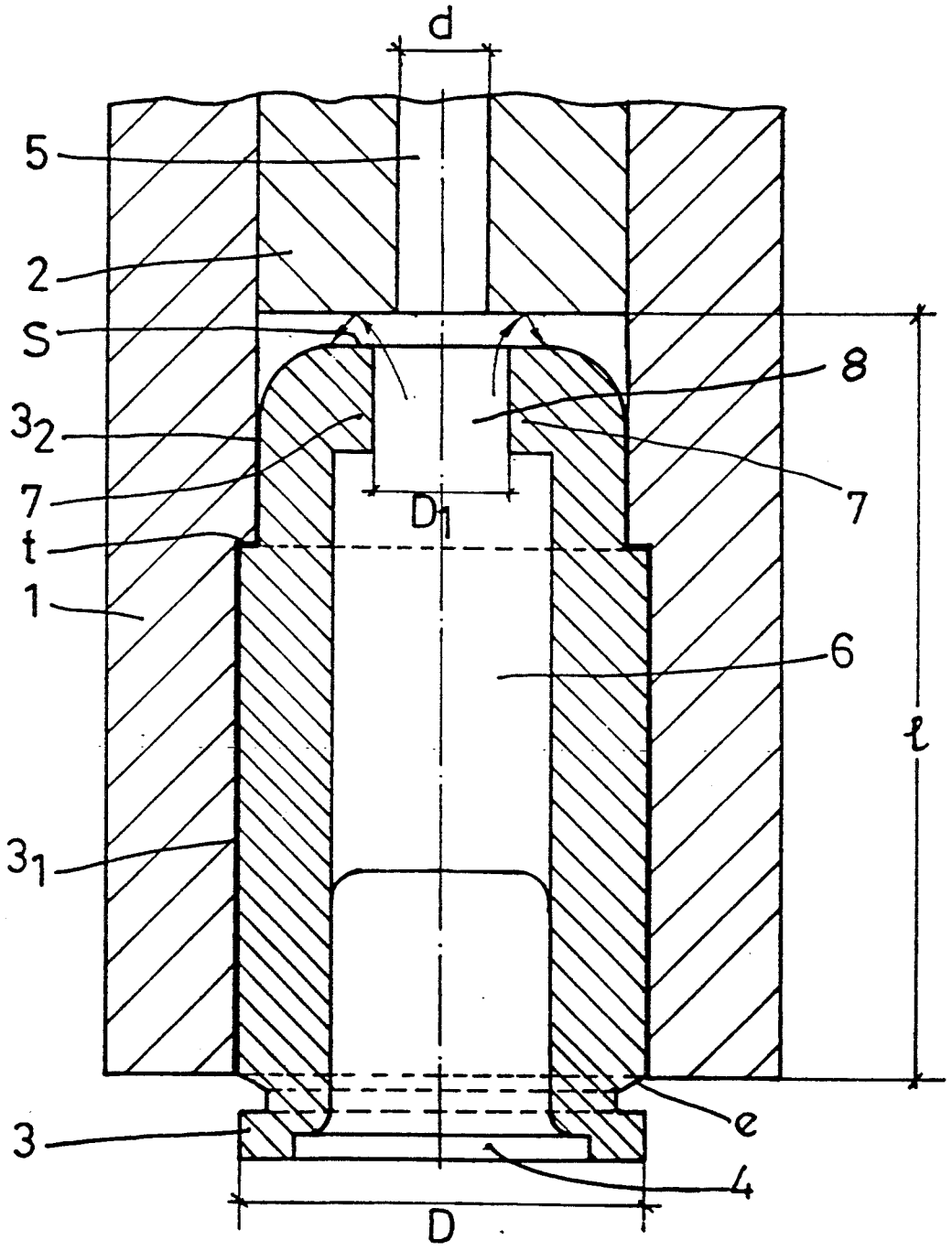

This is a continuation of application Ser. No. 683,531 filed Apr. 10, 1991, now abandoned.

It is well known that the army and the police need to practice and carry out manoeuvres in order to train those persons using equipment either for warfare or as a deterrent.

In the case of automatic or semi automatic firearms, such as machine guns, rifles, pistols and revolvers, practice methods using real ammunition are expensive.

In order to reduce this cost, a solution has been found by simulating firing using a laser beam. However, experienced marksmen have been placed at a disadvantage in that, during this simulation, the firearm is not subject to any recoil or sound, nor is there sufficient recoil energy to make use of the automatic operation facility provided by the firearm.

The applicant for this patent has solved these problems by developing a new type of practice ammunition cartridge, basically comprising a casing and a high explosive, but not including any bullet or any element or any element capable of being projected.

The invention concerns an ammunition cartridge for simulated firing using a laser beam and which comprises a casing which is bored longitudinally and includes, on the inlet side of the bore, a percussion cap, the outlet of the bore being fitted into the orifice of the firearm barrel.

FIG. 1 is a cross sectional view of the ammunition cartridge forming the invention, fitted into the barrel of a firearm.

The barrel of the firearm (1) may comprise a conventional type of barrel, into which is incorporated a sealing plug (2), or, if necessary, a barrel designed for the ammunition cartridge forming the invention may be used, this comprising a one piece body which extends the barrel in order to provide the said sealing plug (2). The diameter (d) of the outlet orifice (5) of the firearm is considerably less than the diameter (D) of the ammunition cartridge.

The laser equipment (not shown) is fitted on the outside of the barrel (1).

The ammunition cartridge comprises a casing (3) which may be made of bronze, stainless steel or any other durable material, if it is required to retrieve and reload the casing (3) following each practice firing, and may be made from a plastic material if it is to be discarded following each practice firing.

The external form of the casing (3) includes an addition which forms a continuation of the external form, preferably, of a conventional casing ($3_1$) and a conventional bullet ($3_2$), it being possible to use the barrel (1) of a conventional firearm with its surfaces acting as stops (t) for the casing ($3_1$).

As the external form of the simulated ammunition cartridge is similar to that of a real projectile, it is necessary to avoid the risk of confusion between them. For this purpose, the end of the sealing plug (2) is located, relative to the inlet side (e) of the barrel (l), at a distance (1) which is less than the length of a real ammunition cartridge so that, if inserted by mistake, its head would be outside and it would not be possible to fire the weapon.

The casing (3) has a longitudinal bore (6) and a percussion cap (4) is positioned on the inlet side, its power considerably exceeding that corresponding to the calibre of the relevant conventional ammunition cartridge. For example, in the case of ammunition cartridges for a semi automatic pistol, percussion caps for mortar shells have been used, the bore fitting into the orifice (5) forming the outlet side of the firearm.

In order to facilitate the automatic discharge of the casing (3), the outlet (8) of the bore (6) of the casing is partially blocked by an internal projection (7), forming an external surface (s) which facilitates the reaction forces relating to the external projection of the ammunition cartridge.

Additional explosive material may be provided within the bore, for example, gunpowder which may be retained in this conventional manner.

The firing energy provided by the percussion cap (4) and, if applicable, by the gun powder results in a level of sound which is similar to that for conventional firing, together with a recoil energy and automatic operation of the firearm and a degree of conventional energy which, on being transmitted through the orifice (5) in the barrel, is capable of activating the laser used for simulated firing.

The casing (3) may be retrieved completely, and, with the addition of a new percussion cap (4) at a cost which is much less than that of a conventional bullet, the ammunition cartridge is again ready for use. If necessary, gun powder or any other conventional explosive may be added.

Preferably, the diameter ($D_1$) on the outlet side of the bore for the ammunition cartridge exceeds the diameter (d) of the barrel orifice (5).

I claim:

1. An ammunition cartridge for simulated firing of a firearm using a laser beam, the firearm having a barrel with a cartridge receiving orifice, which will not accept a conventional cartridge, and an outlet orifice, the ammunition cartridge fitting within the cartridge receiving orifice and comprising a casing which is sized to fit the cartridge receiving orifice, said casing having a bore in the longitudinal direction, the bore having an outlet and an inlet, the bore outlet being of larger diameter than that of said outlet orifice of the firearm and being positioned adjacent said outlet orifice of the firearm when the said cartridge is in place in the said cartridge receiving orifice, the bore outlet having an internal projection, a percussion cap positioned at the inlet of the bore, the percussion cap being of sufficient firing power to activate the laser beam upon firing, the firing power of the percussion cap also being of sufficient power to discharge the said cartridge from the firearm immediately after firing, the percussion cap being the only source of firing power in the said ammunition cartridge, and said ammunition cartridge not including any element capable of being projected from the outlet orifice of the said barrel.

2. An ammunition cartridge for simulated firing of a firearm using a laser beam the firearm having a barrel with a cartridge receiving orifice and an outlet orifice, the ammunition cartridge fitting within the cartridge receiving orifice and comprising a casing, said casing having a bore in the longitudinal direction, the bore having an outlet and an inlet, the bore outlet having an internal projection, a percussion cap positioned at the inlet of the bore, the percussion cap being of sufficient firing power to activate the laser beam upon firing, the firing power of the percussion cap being of sufficient power to discharge the said cartridge from the firearm immediately after firing, the percussion cap being the only source of firing power in the said ammunition cartridge, and said ammunition cartridge not including any element capable of being projected from the outlet orifice of the said barrel.

* * * * *